US009500364B2

(12) United States Patent
Arizmendi Zurutuza et al.

(10) Patent No.: US 9,500,364 B2
(45) Date of Patent: Nov. 22, 2016

(54) SAFETY GAS VALVE

(75) Inventors: Mikel Arizmendi Zurutuza, Gipuzkoa (ES); Ignacio Díez Martínez, Gipuzkoa (ES); Marcos Pablo Curto, Gipuzkoa (ES)

(73) Assignee: Orkli S. Coop, Ordizia (ES)

( * ) Notice: Subject to any disclaimer, the term of this patent is extended or adjusted under 35 U.S.C. 154(b) by 756 days.

(21) Appl. No.: 13/071,275

(22) Filed: Mar. 24, 2011

(65) Prior Publication Data

US 2011/0232627 A1 Sep. 29, 2011

(30) Foreign Application Priority Data

Mar. 24, 2010 (ES) ..... 201030440

(51) Int. Cl.

| | |
|---|---|
| ***F24C 3/08*** | (2006.01) |
| ***F23N 1/00*** | (2006.01) |
| ***F23N 5/10*** | (2006.01) |
| ***F23N 5/24*** | (2006.01) |

(52) U.S. Cl.

CPC ..... *F23N 1/005* (2013.01); *F23N 5/105* (2013.01); *F23N 5/245* (2013.01); *F23N 2035/14* (2013.01)

(58) Field of Classification Search

CPC ..... F23N 1/005; F23N 1/002; F23N 1/007; F23N 5/245; F23N 5/105; F23N 5/107; F23N 5/146

USPC ..... 126/39 BA, 42; 431/66; 137/65, 66; 251/129.2

See application file for complete search history.

(56) References Cited

U.S. PATENT DOCUMENTS

| | | | | |
|---|---|---|---|---|
| 2,513,705 | A * | 7/1950 | Arden | 431/52 |
| 3,469,781 | A * | 9/1969 | Sekera, Jr. | 236/99 R |
| 4,948,093 | A | 8/1990 | Sugawara et al. | |
| 5,226,628 | A * | 7/1993 | Daly | F02M 51/0603 239/585.2 |
| 5,785,511 | A * | 7/1998 | Shah | 431/42 |
| 6,234,189 | B1 | 5/2001 | Koch | |
| 6,886,581 | B2 | 5/2005 | Harniet | |
| 7,044,729 | B2 * | 5/2006 | Ayastuy et al. | 431/25 |

FOREIGN PATENT DOCUMENTS

| | | |
|---|---|---|
| ES | 420874 | 11/1973 |
| GB | 1451347 | 9/1976 |
| GB | 2249382 A | 5/1992 |

* cited by examiner

*Primary Examiner* — Avinash Savani
*Assistant Examiner* — Vivek Shirsat
(74) *Attorney, Agent, or Firm* — Edell, Shapiro & Finnan LLC

(57) ABSTRACT

A gas safety valve with a casing having a gas inlet and a gas outlet. An electromagnet disposed in the casing is situated to act on an arm within the casing that pivots to permit gas flow through between the gas inlet and outlet when the electromagnet is energized. When the electromagnet is not energized the arm closes to impede gas flow through the valve. During normal operation a thermocouple provides power to the electromagnet to hold the valve in an open position. An auxiliary power source is also electrically coupled with the electromagnet to provide power to the electromagnet when the thermocouple generates insufficient power to maintain the valve in an open position.

14 Claims, 3 Drawing Sheets

SAFETY GAS VALVE

CROSS-REFERENCE TO RELATED APPLICATIONS

The present application relates to and claims the benefit of Spanish Patent Application No. P201030440, filed Mar. 24, 2010.

TECHNICAL FIELD

The implementations disclosed herein relate to safety gas valves.

BACKGROUND

There are known gas burning domestic-appliances that include thermoelectric safety devices that close the passage of gas to a burner of the appliance in the absence of a flame. Thermoelectric safety devices generally include magnetic units connected to a thermocouple, with the result that as long as there is a flame in the burner the thermocouple is heated to produce sufficient power to keep the magnetic unit energized to enable the passage of gas through the thermoelectric safety device to the burner. In the absence of a flame, the thermocouple is not heated resulting in insufficient power being supplied to the magnetic unit with the result that the magnetic unit is de-energized causing a closure of the passage of gas to the burner.

Known magnetic units in the prior art comprise an electromagnet, a frame that closes against the electromagnet when the magnetic unit is energized, and a sealing member that closes the passage of gas to the burner when it closes against a corresponding seating, the sealing member being attached to the frame by a shaft. From the moment the burner is lit until the thermocouple is able to keep the magnetic unit energized a period of time elapses, with the result that the thermoelectric device must have auxiliary means which, once the magnetic unit has been reset manually, enable the magnetic unit to be kept energized until the thermocouple is able to do so by itself.

Known thermoelectric safety devices are disclosed in Spanish Patent Application No. ES 0420874 A1, U.S. Pat. Nos. 6,886,581 B2 and 6,234,189 B1.

SUMMARY

According to an implementation a thermoelectric safety actuator is provided that comprises an electromagnet that is connected to a thermocouple, a frame that closes against the electromagnet when the electromagnet is energized, a sealing member operatively coupled to the frame, which in a rest position closes against a seating preventing the passage of gas to the burner. According to one implementation an auxiliary energizing means is connected to the electromagnet and adapted to keep the electromagnet energized until the thermocouple is able to keep the electromagnet energized. In one implementation the thermoelectric safety actuator comprises a swinging arm on a first end of which the frame is arranged fixed and on a second end of which the sealing member is arranged fixed, the swinging arm swinging between a rest position, wherein the passage of gas to the burner is closed and an activation position, wherein the electromagnet is energized and the passage of gas open.

As a result, a thermoelectric safety actuator is provided that may initially be energized by the auxiliary energizing means, there being no need for the user, either manually or by supplying an excessive electrical current, to reset the frame against the core of the electromagnet. The thermoelectric safety actuator is thus initially energized by the auxiliary energizing means, and kept energized by the auxiliary energizing means until the thermocouple is able to keep the electromagnet energized.

According to an implementation a gas safety valve is provided comprising: a casing having a gas inlet, a gas outlet and a valve seat situated between the gas inlet and the gas outlet; an electromagnet disposed in the casing and electrically coupled to an electrical connection terminal integrated with or connected to the casing; and an arm situated within the casing that pivots between a first position and a second position, the arm biased in a first rotational direction toward the first position and having at a first end a valve member and at a second end a ferromagnetic member, when the arm is in the first position the valve member contacts the valve seat to prevent gas flow between the gas inlet and the gas outlet, upon power being supplied to the electromagnet via the electrical connection terminal the ferromagnetic member is attracted and moved toward the electromagnet to cause the arm to move in a second rotational direction opposite the first rotational direction to assume the second position, upon the arm being rotated in the second rotational direction the valve member is moved away from the valve seat to permit gas flow between the gas inlet and the gas outlet.

According to an implementation a gas valve assembly adapted to supply a gas to a burner of a domestic appliance is provided, the gas valve comprising: a first flow control valve assembly comprising a first valve body having a first gas inlet, a first gas outlet and a regulatory organ situated in the valve body between the first gas inlet and the first gas outlet, the regulatory organ rotatable within the first valve body by a hand operated drive shaft to vary the flow of gas through the first flow control valve; and a second flow control valve assembly coupled to the first flow control valve assembly comprising: a second valve body having a second gas inlet coupled to the first gas outlet, a second gas outlet and a valve seat situated between the second gas inlet and the second gas outlet; an electromagnet disposed in the second valve body and electrically coupled to an electrical connection terminal integrated with or connected to the second valve body; and an arm situated within the second valve body that pivots between a first position and a second position, the arm biased in a first rotational direction toward the first position and having at a first end a valve member and at a second end a ferromagnetic member, when the arm is in the first position the valve member contacts the valve seat to prevent gas flow between the second gas inlet and the second gas outlet, upon power being supplied to the electromagnet via the electrical connection terminal the ferromagnetic member is attracted and moved toward the electromagnet to cause the arm to move in a second rotational direction opposite the first rotational direction to assume the second position, upon the arm being rotated in the second rotational direction the valve member is moved away from the valve seat to permit gas flow between the second gas inlet and the second gas outlet.

In accordance with another implementation an appliance having a gas burner is provided comprising: a first flow control valve assembly comprising a first valve body having a first gas inlet, a first gas outlet and a regulatory organ situated in the valve body between the first gas inlet and the first gas outlet, the regulatory organ rotatable within the first valve body by a hand operated drive shaft to vary the flow of gas through the first flow control valve, the regulatory organ rotatable between a closed position to obstruct the flow of gas through the first flow control valve and one or more open positions to permit the flow of gas through the first flow control valve; a second flow control valve assembly comprising: a second valve body having a second gas inlet coupled to the first gas outlet, a second gas outlet and a valve seat situated between the second gas inlet and the second gas outlet; an electromagnet disposed in the second valve body and electrically coupled to an electrical connection terminal integrated with or connected to the second valve body; an arm situated within the second valve body that pivots between a first position and a second position, the arm biased in a first rotational direction toward the first position and having at a first end a valve member and at a second end a ferromagnetic member, when the arm is in the first position the valve member contacts the valve seat to prevent gas flow between the second gas inlet and the second gas outlet, upon power being supplied to the electromagnet via the electrical connection terminal the electromagnet is energized and the ferromagnetic member is attracted and moved toward the electromagnet to cause the arm to move in a second rotational direction opposite the first rotational direction to assume the second position, upon the arm being rotated in the second rotational direction the valve member is moved away from the valve seat to permit gas flow between the second gas inlet and the second gas outlet; a thermocouple situated near the burner and electrically coupled with the electrical connection terminal, the thermocouple configured to generate electrical power to energize the electromagnet upon being heated by the burner; and an auxiliary power source coupled with the electrical connection terminal.

In accordance with another implementation an automatic ignition system for a gas burner in a domestic appliance is provided comprising: a thermoelectric safety valve having a valve body with a gas inlet, a gas outlet and a valve seat situated between the gas inlet and the gas outlet, an electromagnet disposed in the valve body and electrically coupled to an electrical connection terminal integrated with or connected to the valve body, the electromagnet having an upper transverse surface, an arm situated within the valve body that pivots between a first position and a second position, the arm biased in a first rotational direction toward the first position and having at a first end a valve member and at a second end a ferromagnetic member, when the arm is in the first position the valve member contacts the valve seat to prevent gas flow between the gas inlet and the gas outlet, upon power being supplied to the electromagnet via the electrical connection terminal the ferromagnetic member is attracted and moved toward the upper transverse surface of the electromagnet to cause the arm to move in a second rotational direction opposite the first rotational direction to assume the second position, upon the arm being rotated in the second rotational direction the valve member is moved away from the valve seat to permit gas flow between the second gas inlet and the second gas outlet; a thermocouple situated near the burner and electrically coupled with the electrical connection terminal, the thermocouple configured to generate electrical power to energize the electromagnet upon being heated by the burner; an auxiliary power source coupled with the electrical connection terminal; an electrical flame ignition device situated near the burner, the flame ignition device electrically coupled to the auxiliary power source and configured to produce a flame in the burner upon gas being supplied to the burner; and a switch coupled with the auxiliary power source and when acted upon by a user causes the auxiliary power source to supply power to the electromagnet and to the electrical flame ignition device for a pre-set period of time, the pre-set period of time being sufficient for the thermocouple, under normal operating conditions, to energize the electromagnet upon being heated by the burner.

DETAILED DESCRIPTION

Figure 1:
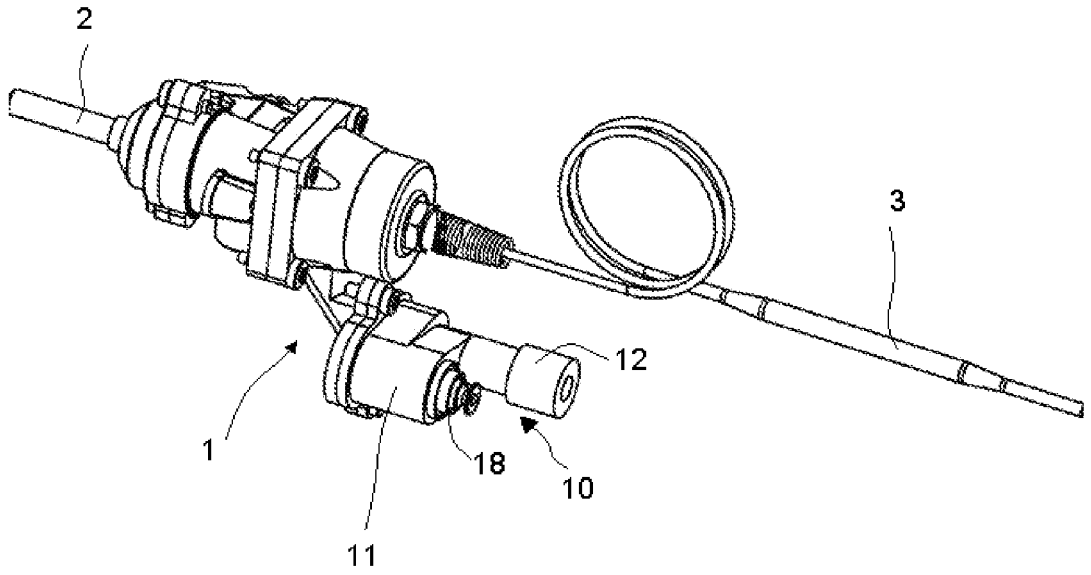
FIG. 1 shows a perspective view of a gas valve assembly according to an implementation.

FIG. 1 shows a gas valve assembly according to one implementation. The gas valve assembly includes a valve body 1 adapted to be attached to a gas burning domestic gas appliance (e.g., ovens, heaters, etc.) not shown in the figures. The gas valve assembly may comprise a drive shaft 2 adapted to connect a control device (not shown in the figures) to, for example, a conical regulation member (not visible in FIG. 1) which regulates the flow of gas through the valve body 1 to the burner. The valve body 1 comprises other elements known in the art which are not described herein. The gas valve assembly also comprises a thermoelectric safety actuator 10 that prevents the passage of gas through an outlet conduit 12 and to the burner 6 in the absence of flame in the burner.

Figure 5:
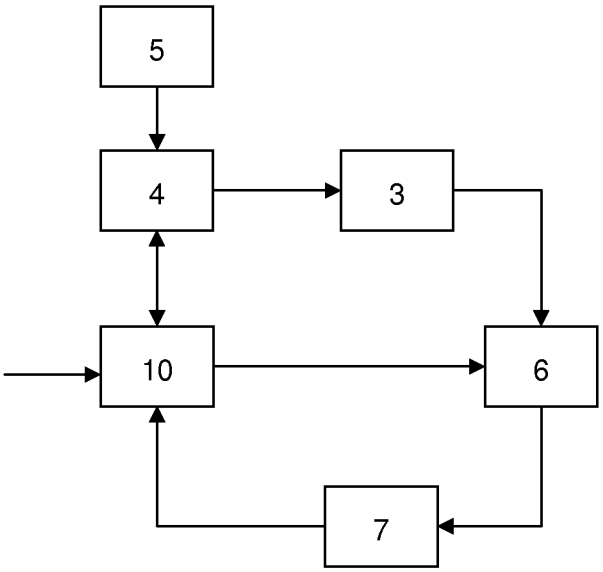
FIG. 5 shows a diagram of an automatic ignition system of a burner according to an implementation.

According to one implementation, as shown in FIG. 1 and also schematically in FIG. 5, ignition means 3 is arranged connected to the valve body 1 and functions to ignite gas in the burner 6. In one implementation the ignition means is a spark generator. The ignition means 3 is electrically coupled to and activated by an auxiliary energizing means/power source 4. A flame thermocouple 7 is arranged near the burner 6 and electrically coupled to the thermoelectric safety actuator 10.

Figure 2:
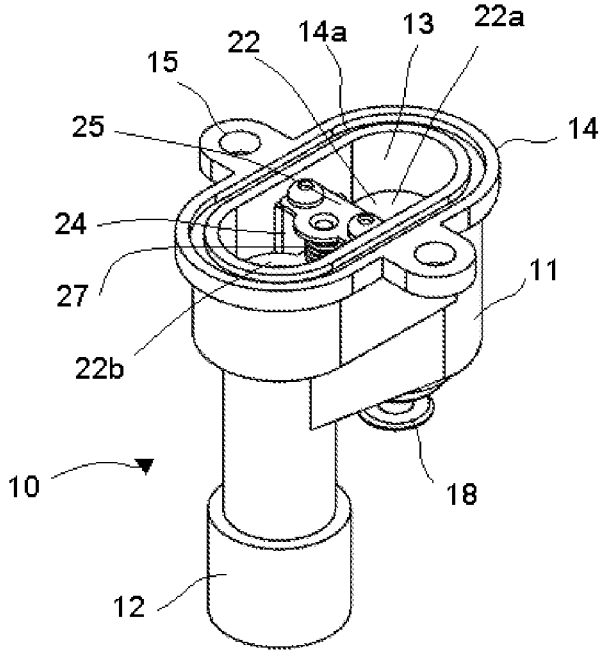
FIG. 2 shows a perspective view of a thermoelectric safety actuator according to an implementation.
Figure 3:
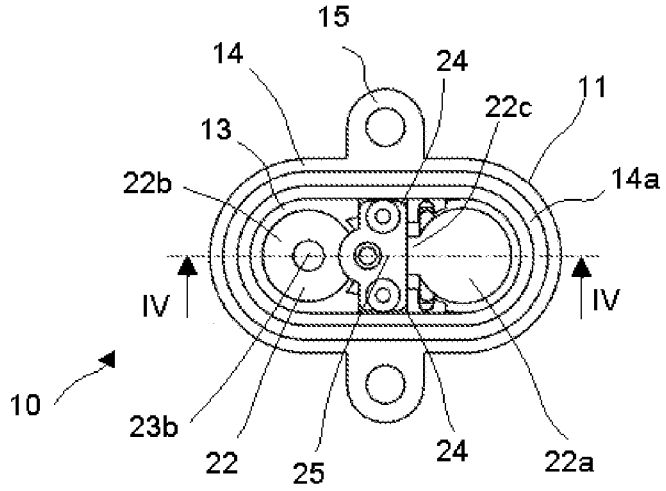
FIG. 3 is a top view of the thermoelectric safety actuator shown in FIG. 2.
Figure 4:
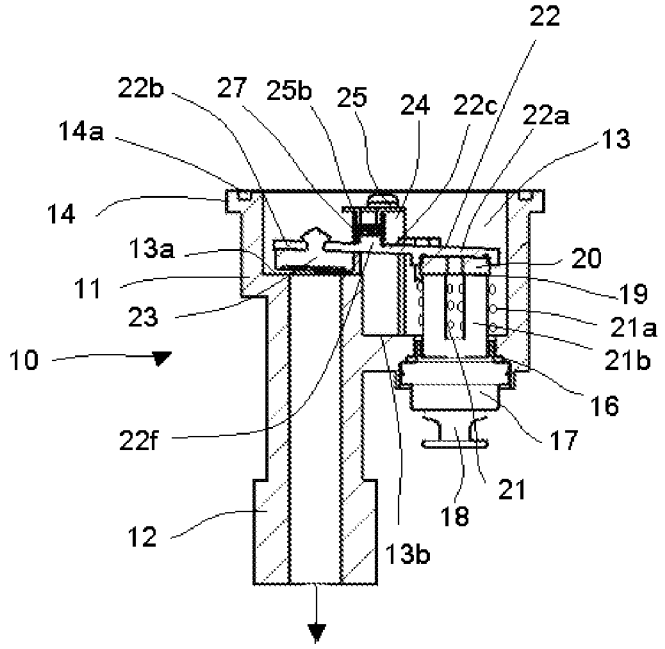
FIG. 4 is a cross-section side view of the thermoelectric safety actuator shown in FIG. 3 taken along the IV-IV line.

The thermoelectric safety actuator 10 shown in FIGS. 2 to 4 comprises a casing 11, a gas outlet conduit 12 built into the casing 11, and an electromagnet 21. In one implementation the electromagnet 21 comprises a core 21*a*, preferably U-shaped with a single coil 21*b* wound around the core 21*a*. A swinging arm 22 located within the casing having a first end 22*a* with a ferromagnetic frame 20 fixed thereto, and a second end 22*b* of which a sealing member 23 is fixed. The frame 20 closes against transverse free surfaces 19 of the electromagnet 21 when the electromagnet 21 is energized. In a rest position of the thermoelectric safety actuator the sealing member 23 closes against a seating 13*a* of the gas outlet conduit 12. The thermoelectric safety actuator 10 also comprises means 27 of returning the swinging arm 22 from an activation position, in which the electromagnet 21 is energized and the sealing member 23 is separated from the seating 13*a*, to the rest position in which the sealing member 23 closes against the seating 13*a* to close the passage of gas to the burner.

In one implementation the thermoelectric safety actuator 10 also comprises a metal sleeve 17 providing an electrical connection to the mass, on which is fixed the electromagnet 21, a connection terminal 18 being arranged connected on the end opposite to the electromagnet 21, through which the thermocouple 7 and the auxiliary energizing means 4, shown schematically in FIG. 5, are connected to the thermoelectric safety actuator 10.

In one implementation the casing 11 comprises a housing 13 inside which is tightly housed the electromagnet 21, the frame 20, the sealing member 23 and the swinging arm 22. In one implementation the housing 13 is delimited by a bottom surface 13*b* that includes an opening 16 passed through at least partially by the sleeve 17, which acts as a seating of the electromagnet 21, and by the electromagnet 21 itself, the sleeve 17 being fixed to the casing 11 through the opening 16. In one implementation seating 13*a* is located a first distance from the bottom surface 13*b* of the housing 13 and the upper transverse surface 19 of the electromagnet 21 is spaced a second distance from the bottom surface 13*b* of the housing 13 with the second distance being greater than the first distance. According to one implementation the first distance and second distance are selected so that when the electromagnet 21 is energized a first gap between the seating 13*a* and the sealing member 23 is established to permit the passage of gas to the burner 6 and so that when the electromagnet 21 is de-energized the sealing member 23 comes against the seating 13*a* and a second gap is established between the frame 20 and the upper transverse surface 19 of the electromagnet 21, the second gap being sufficiently small to cause the frame 20 to be drawn against the upper transverse surface 19 of the electromagnet 21 when the electromagnet 21 is energized by the auxiliary power source 4.

In one implementation fixed supports 24 are provided within the casing to support swinging arm 22. In one implementation the fixed supports 24 are connected by means of a plate 25, the fixed supports 24 arranged substantially orthogonal to the swinging arm 22, as shown in FIG. 2. The plate 25, which in one implementation is substantially rectangular, includes a projection 25*b* that projects out axially, on which the return means 27 is coupled. The swinging arm 22 also includes a projection 22*f* that projects out axially from a surface 22*c* of the swinging arm 22 that is arranged facing the plate 25, the return means 27 of the swinging arm 22 being coupled with the projection 22*f*. The projection 22*f* of the swinging arm 22 is arranged displaced in relation to one of the axes of symmetry of the swinging arm 22. In one implementation the return means 27 comprises a spring, with the result that by means of the spring 27 the swinging arm 22 is arranged coupled to the plate 25, it being capable of swinging between the rest position and the activation position.

In one implementation the casing 11 of thermoelectric safety actuator 10 is fixed to the valve body 1, for the purposes of which the casing 11 comprises on the end opposite the gas outlet conduit 12 and the opening 16, a base 14, the base 14 including external tabs 15, or other means, by which the thermoelectric actuator 10 is fixed to the valve body 1. In one implementation a seal washer (not shown) is situated within a recess 14*a* in the base 14 to provide a gas tight seal between a gas outlet in valve body 1 and the casing inlet. In various implementations the thermoelectric safety actuator 10 is configured to be fitted to the valve body 1 quickly and easily. In some implementations the thermoelectric safety actuator 10 is capable of being fitted to different types of valve bodies. The modular design also facilitates maintenance, as elements forming part of the safety actuator 10 may be easily replaced.

FIG. 5 shows an automatic ignition system of a gas burning domestic appliance, which comprises the thermoelectric safety actuator 10, the auxiliary energizing means 4 (comprising an electronic driver) connected to the thermoelectric safety actuator 10 by means of the connection terminal 18, the thermocouple 7 connected to the thermoelectric safety actuator 10 by means of the connection terminal 18 and arranged close to the corresponding burner 6, and ignition means 3 connected to the auxiliary energizing means 4 and arranged close to the burner 6.

According to one implementation when the user activates a control switch 5 to light the burner 6, the control switch 5 sends the corresponding command to the auxiliary energizing means 4 so that it provides the necessary electric power to the electromagnet 21 in order to energize it, attracting the frame 20 without the need for the user to act directly on the electromagnet 21 and position the frame 20 against the electromagnet 21 manually. The auxiliary energizing means 4 provides the necessary electric power to attract the frame 20 to the electromagnet 21 and to keep the electromagnet energized for a certain period of time at the same time it acts on the ignition means 3. If the flame has been lit, the thermocouple 7 heats up and also generates electric power with which the electromagnet 21 is supplied so that it can continue to be energized without consuming energy. The ignition system may thus be supplied initially by standard batteries.

Following an initial pre-set time, the supply of electric power from the auxiliary energizing means 4 to the actuator 10 is terminated, with the result that if there is no flame or insufficient flame in the burner the swinging arm 22 of the actuator 10 is moved to the rest position, closing the passage of gas to the burner as a result of the thermocouple 7 generating insufficient electric power to keep the electromagnet 21 energized.

In one implementation, in the event that the flame has gone out, the auxiliary energizing means 4 activates the ignition means 3 again in an attempt to relight the flame. If the gas in the burner does not reignite to produce a flame, the actuator 10 closes the passage of gas as a result of the thermocouple 7 producing insufficient energy to power the electromagnet 21.

What is claimed is:

1. A gas valve assembly adapted to supply a gas to a burner of a domestic appliance, the gas valve comprising:

a first flow control valve assembly comprising a first valve body having a first gas inlet, a first gas outlet and a regulatory organ situated in the valve body between the first gas inlet and the first gas outlet, the regulatory organ rotatable within the first valve body by a hand operated drive shaft to vary the flow of gas through the first flow control valve; and a second flow control valve assembly coupled to the first flow control valve assembly comprising:

a second valve body having a second gas inlet coupled to the first gas outlet, a second gas outlet and a valve seat situated between the second gas inlet and the second gas outlet, an electromagnet disposed within a cavity in the second valve body and electrically coupled to an electrical connection terminal integrated with or connected to the second valve body, the electromagnet having a first end located at or near a bottom surface of the cavity and a second end opposite the first end, the second end of the electromagnet having an upper surface, the valve seat located a first distance above the bottom surface of the cavity, the entirety of the upper surface of the electromagnet spaced a second distance above the bottom surface of the cavity, the second distance being greater than the first distance; and an arm situated within the second valve body that pivots about an axis of rotation between a first position and a second position, the arm having a longitudinal length, the second end of the electromagnet located nearer the axis of rotation than the first end of the electromagnet, the arm biased in a first rotational direction toward the first position and having at a first longitudinal location a valve member and at a second longitudinal location spaced away from the first longitudinal location a ferromagnetic member that is configured to be electromagnetically coupled to the electromagnet when the electromagnet is energized, when the arm is in the first position the valve member contacts the valve seat to prevent gas flow between the second gas inlet and the second gas outlet, when the arm is in the first position and power is supplied to the electromagnet via the electrical connection terminal the ferromagnetic member is attracted and moved toward the upper surface of the electromagnet without the need of a user to physically act on the ferromagnetic member to cause the arm to move in a second rotational direction opposite the first rotational direction to assume the second position, upon the arm being rotated in the second rotational direction the valve member is moved away from the valve seat to permit gas flow between the second gas inlet and the second gas outlet, the arm being biased in the first rotational direction by a spring having a first end coupled to the arm at a third longitudinal location of the arm, the third longitudinal location of the arm located between the first and second longitudinal locations and spaced apart from each of the first and second longitudinal locations, the arm is supported by a fixed support, the spring having a second end coupled to a plate attached to the fixed support.

2. A gas valve assembly according to claim 1, wherein the electromagnet comprises a substantially U-shaped core and a single coil wound around the core, the coil being connected to the electrical connection terminal.

3. A gas valve assembly according to claim 1, comprising a gas outlet conduit that extends between the valve seat and the second gas outlet, the electromagnet having elongate transverse surfaces that are arranged substantially orthogonal to the bottom surface of the cavity, the elongate transverse surfaces arranged substantially parallel to the gas outlet conduit.

4. An appliance having a gas burner, the appliance comprising:

a first flow control valve assembly comprising a first valve body having a first gas inlet, a first gas outlet and a regulatory organ situated in the valve body between the first gas inlet and the first gas outlet, the regulatory organ rotatable within the first valve body by a hand operated drive shaft to vary the flow of gas through the first flow control valve, the regulatory organ rotatable between a closed position to obstruct the flow of gas through the first flow control valve and one or more open positions to permit the flow of gas through the first flow control valve, a second flow control valve assembly comprising:

a second valve body having a second gas inlet coupled to the first gas outlet, a second gas outlet and a valve seat situated between the second gas inlet and the second gas outlet, an electromagnet disposed within a cavity in the second valve body and electrically coupled to an electrical connection terminal integrated with or connected to the second valve body, the electromagnet having a first end located at or near a bottom surface of the cavity and a second end opposite the first end, the second end of the electromagnet having an upper surface, the valve seat located a first distance above the bottom surface of the cavity, the entirety of the upper surface of the electromagnet spaced a second distance above the bottom surface of the cavity, the second distance being greater than the first distance, an arm situated within the second valve body that pivots about an axis of rotation between a first position and a second position, the arm having a longitudinal length, the second end of the electromagnet located nearer the axis of rotation than the first end of the electromagnet, the arm biased in a first rotational direction toward the first position and having at a first longitudinal location a valve member and at a second longitudinal location spaced away from the first longitudinal location a ferromagnetic member that is configured to be electromagnetically coupled to the electromagnet when the electromagnet is energized, when the arm is in the first position the valve member contacts the valve seat to prevent gas flow between the second gas inlet and the second gas outlet, when the arm is in the first position and power is supplied to the electromagnet via the electrical connection terminal the electromagnet is energized and the ferromagnetic member is attracted and moved toward the upper surface of the electromagnet without the need of a user to physically act on the ferromagnetic member to cause the arm to move in a second rotational direction opposite the first rotational direction to assume the second position, upon the arm being rotated in the second rotational direction the valve member is moved away from the valve seat to permit gas flow between the second gas inlet and the second gas outlet, the arm being biased in the first rotational direction by a spring having a first end coupled to the arm at a third longitudinal location of the arm, the third longitudinal location of the arm located between the first and second longitudinal locations and spaced apart from each of the first and second longitudinal locations, the arm is supported by a fixed support, the spring having a second end coupled to a plate attached to the fixed support; and an auxiliary power source coupled with the electrical connection terminal.

5. An appliance according to claim 4, further comprising an electrical flame ignition device situated near the burner, the flame ignition device electrically coupled to the auxiliary power source.

6. An appliance according to claim 4, further comprising a control switch coupled with the auxiliary power source that may be acted upon by a user of the appliance to activate the auxiliary power source to energize the electromagnet for a pre-set period of time.

7. An appliance according to claim 5, further comprising a control switch coupled with the auxiliary power source that may be acted upon by a user of the appliance to activate the auxiliary power source to energize the electromagnet and the flame ignition device for a pre-set period of time.

8. An appliance according to claim 5, wherein the auxiliary power source, the electromagnet and the flame ignition device are part of a control circuit, the control circuit comprising a switch coupled with the auxiliary power source and when acted upon by a user causes the auxiliary power source to supply power to the electromagnet and to the electrical flame ignition device for a pre-set period of time.

9. An appliance according to claim 4, wherein the auxiliary power source comprises a battery.

10. An appliance according to claim 5, wherein the auxiliary power source comprises a battery.

11. An appliance according to claim 6, wherein the auxiliary power source comprises a battery.

12. An appliance according to claim 7, wherein the auxiliary power source comprises a battery.

13. An appliance according to claim 4, wherein the electromagnet comprises a substantially U-shaped core and a single coil wound around the core, the coil being connected to the electrical connection terminal.

14. An appliance according to claim 4, comprising a gas outlet conduit that extends between the valve seat and the second gas outlet, the electromagnet having elongate transverse surfaces that are arranged substantially orthogonal to the bottom surface of the cavity, the elongate transverse surfaces arranged substantially parallel to the gas outlet conduit.

* * * * *